US005689905A

United States Patent [19]

Ibusuki

[11] Patent Number: 5,689,905

[45] Date of Patent: Nov. 25, 1997

[54] HYDRAULIC SHOVEL WITH ARM INCORPORATING BREAKER

[75] Inventor: Yasuhiro Ibusuki, Kanagawa, Japan

[73] Assignee: Komatsu Ltd., Tokyo, Japan.

[21] Appl. No.: 604,942

[22] PCT Filed: Aug. 25, 1994

[86] PCT No.: PCT/JP94/01408

§ 371 Date: Feb. 29, 1996

§ 102(e) Date: Feb. 29, 1996

[87] PCT Pub. No.: WO95/06786

PCT Pub. Date: Sep. 3, 1995

[30] Foreign Application Priority Data

Aug. 30, 1993 [JP] Japan ..... 5-238921

[51] Int. Cl.[6] ..... E02F 3/96

[52] U.S. Cl. ..... 37/403; 37/408; 414/912; 172/438

[58] Field of Search ..... 37/403, 468, 404, 37/405, 406, 407, 408, 409, 410; 414/912, 722, 724, 723; 172/438

[56] References Cited

U.S. PATENT DOCUMENTS

| | | | |
|---|---|---|---|
| 3,586,113 | 6/1971 | Grant | 37/403 X |
| 3,710,472 | 1/1973 | Gremillion et al. | 37/403 X |
| 4,087,010 | 5/1978 | Stormon | 37/403 X |
| 4,099,579 | 7/1978 | Stormon | 414/724 X |
| 4,230,435 | 10/1980 | Azevedo | 414/722 |
| 4,466,494 | 8/1984 | Hanson | 37/403 X |
| 4,602,821 | 7/1986 | Schaeff | 37/403 X |
| 5,115,583 | 5/1992 | Vail | 37/403 X |
| 5,197,212 | 3/1993 | Vail | 37/403 |
| 5,456,028 | 10/1995 | Larson | 37/410 X |

FOREIGN PATENT DOCUMENTS

| | | | |
|---|---|---|---|
| 51-7708 | 1/1976 | Japan . | |
| 4-119847 | 10/1992 | Japan . | |
| 001313956 A | 5/1987 | U.S.S.R. | 37/410 |

*Primary Examiner*—Terry Lee Melius
*Assistant Examiner*—Victor Batson
*Attorney, Agent, or Firm*—Sidley & Austin

[57] ABSTRACT

A working machine of a hydraulic shovel which enables easy attaching and detaching of a chisel and affords smooth breaker work even in the vicinity of a wall, while enhancing chisel penetration and correspondingly improving the efficiency of the work. To this end, a bucket hinge pin (**6*d*) is provided on one end of each of a pair of bucket brackets (6*b*) at a position offset from the axis of a breaker-incorporating arm (4*b*) toward the bucket cylinder (7), and, while the bucket (6) is in the tilted position, the chisel (10) is attached so as to extend through a space between the bucket hinge pin (6*d*) and the bucket link pin (8*b*) which is provided on the other ends of the bucket brackets (6*b***).

14 Claims, 9 Drawing Sheets

UNLOCKED

LOCKED

HYDRAULIC SHOVEL WITH ARM INCORPORATING BREAKER

TECHNICAL FIELD

The present invention relates to a hydraulic power shovel with an arm incorporating a breaker, capable of mounting both an excavating bucket and a breaker chisel.

BACKGROUND ART

Referring to FIG. 8, a conventional hydraulic shovel apparatus has a main structure 1, comprising a lower travelling structure la and an upper turret structure 1*b*, and is equipped with a working machine which is swingably attached to the front side of the main structure 1 and which is composed of various parts such as boom 2, boom cylinder 3, arm 4, arm cylinder 5, bucket 6, bucket cylinder 7, bucket link 8, intermediate link 9, and so forth. Hydraulic shovels, having the described constructions, are widely used for various purposes including excavation.

In the meantime, currently known are hydraulic shovel working machines of the type in which the arm 4 is replaced by a breaker-incorporating arm which incorporates a breaker mechanism and which detachably carries at its end a chisel for breaking operation (see, for example, Japanese Utility Model Laid-Open No. 4119847). The operation for attaching the chisel to the working machine is as follows. The bucket cylinder 7 is operated in the contracting direction so that the bucket 6 is moved forwardly, i.e., to a dumping position, through the action of the bucket links 8, the intermediate links 9, and the bucket brackets 6*a*, as shown in FIG. 9. A detachable chisel 10 is attached to the end of the breaker-incorporating arm 4*a* in this state. According to this arrangement, the apparatus becomes ready for performing breaker work, required in rock cutting or pavement breaking simply by attaching the chisel 10 in a short time. This eliminates laborious work which otherwise may be required for detaching the bucket 6 from the working machine of the hydraulic shovel and mounting a breaker as an independent attachment, thus reducing the man-hours required in replacement work.

The above-described working machine of hydraulic shovel apparatus, however, suffers from a problem in that the breaking area is restricted, particularly when the breaking work has to be done in the vicinity of a wall without demounting the bucket 6, because the chisel 10 can be attached only when the bucket 6 is in the dumping position. More specifically, referring to FIG. 10, when breaking work is conducted in the vicinity of a wall W, the bucket cylinder 7 is contracted so as to set the bucket 6 to the dumping position while keeping the chisel 10 in a vertical posture, but a wide area is left without being broken, corresponding to the distance $l_1$ between the chisel 10 and the wall W. In addition, insufficient penetration depth is caused because the penetration of the chisel 10 is limited to h1. This problem would be overcome by demounting the bucket 6. Such a solution, however, impairs the working efficiency because the demounting of the bucket 6 is necessary each time the breaking work is to be performed.

SUMMARY OF THE INVENTION

The present invention is aimed at obviating the above described problem of the known arts. Thus, an object of the present invention is to provide a hydraulic shovel which is equipped with an arm incorporating a breaker and which permits easy attaching/detaching of a chisel without requiring a bucket to be demounted from an arm, while achieving increased chisel penetration and improved efficiency of work, such as breaker work in the vicinity of a wall.

To this end, the present invention in its first aspect provides a hydraulic shovel with an arm incorporating a breaker, comprising: a boom pivotally connected to a hydraulic shovel; the arm incorporating the breaker and pivotally connected to an end of the boom; an arm cylinder pivotally connected between the arm incorporating the breaker and the boom; a bucket having a pair of bucket brackets fixed thereto, each bucket bracket having one end pivotally connected to a bracket provided on an end of the arm incorporating the breaker; a pair of bucket links each having one end pivotally connected to one of the bucket brackets and the other end pivotally connected to an intermediate link; the intermediate link having one end pivotally connected to the bracket provided on the end of the arm incorporating the breaker and the other end pivotally connected to the bucket link; and a bucket cylinder having one end connected to the arm incorporating the breaker and the other end connected to the intermediate link and the bucket links; wherein breaker work is performed with a chisel which, while said bucket is in the tilted condition, is attached to the arm incorporating the breaker through the space defined between the pair of the bucket brackets and between the pair of bucket links at predetermined distances therefrom or attached to the same arm incorporating the breaker while said bucket is in the dumping condition.

An edge of the bucket between the pair of bucket brackets can be provided with a notch which is spaced a predetermined distance from the chisel attached to the arm incorporating the breaker while the bucket is in the tilted condition.

According to a second aspect of the present invention, there is provided a hydraulic shovel with an arm incorporating a breaker, having a working machine which is mounted on a front portion of an upper turret structure and which includes a boom, an arm incorporating a breaker, and a bucket, wherein a bucket hinge pin is provided on the arm incorporating the breaker with an offset from the axis of the arm incorporating the breaker towards the bucket cylinder, and wherein breaker work is performed with a chisel which, while said bucket is in the tilted condition, is attached to the arm incorporating the breaker through the space defined between the pair of the bucket brackets and between the bucket hinge pin and the bucket link pin or attached to the same arm incorporating the breaker while said bucket is in the dumping condition. The chisel may be attached, while said bucket is in a tilted condition, so as to extend through the space defined between the bucket hinge pin and the bucket link pin and between the pair of bucket brackets which are spaced a predetermined distance from each other.

In the first and second aspects of the invention having the features stated above, when a breaker work has to be conducted, the bucket cylinder is extended so that the bucket, which is pivotally secured to the end of the arm incorporating the breaker through a pair of brackets, is swung towards the tilted position by the action of the intermediate link and the bucket links. As a result of this swinging motion, the bucket brackets move across the end of the arm incorporating the breaker, so that the bucket is moved to one side of the arm incorporating the breaker, whereby a space through which the chisel is to be mounted and attached is preserved between the bucket hinge pin and the bucket link pin. In this state, the chisel can be mounted through the space between the pair of bucket links and attached to the arm incorporating the breaker, thus enabling the hydraulic shovel to perform breaker work. Since the chisel is attached under such a condition that the bucket is in the tilted condition, breaker work in the vicinity of a wall can be executed without causing interference between the wall and the bucket, so that the chisel can approach the wall to perform breaking operation in close proximity to the wall, thus achieving higher work efficiency. Furthermore, chisel penetration can be increased as compared with the conventional apparatuses, because the distance between the pavement surface and the bottom of the bucket or bucket bracket can be increased by setting the bucket in the tilted position, whereby the working machine can be adapted to a wider scope of work. It is possible to attach the chisel to the arm incorporating the breaker also when the bucket is in the dumping position, so that the breaker work can be performed with selection as necessary between the state in which the bucket is in the tilted condition and the state in which the bucket is in the dumping condition, thus facilitating clearing of the obstacle. The same advantages can be enjoyed also when the chisel is driven through the predetermined spacing between the pair of bucket brackets. When the breaker work is finished, the chisel is demounted from the breaker-incorporating arm, so that the hydraulic shovel becomes ready for ordinary excavating work. Notching at the bucket edge enables the lengths of the bucket bracket and bucket link to be reduced almost to the same lengths as those in conventional apparatuses, so that the excavating operation can be performed almost in the same sense of operation as that in conventional apparatuses.

BRIEF DESCRIPTION OF THE DRAWINGS

FIGS. 1A and 1B are illustrations of a relevant portion of a first embodiment of the hydraulic shovel working machine in a state in which a bucket is tilted to allow attaching of a chisel, wherein FIG. 1A is a side elevational view, while FIG. 1B is a bottom plan view;

FIGS. 4A, 4B and 4C are views as viewed in the direction of the arrow Z in FIG. 3, illustrative of the method for locking and unlocking the chisel, wherein FIG. 4A is an illustration of a tool, FIG. 4B is an illustration of the chisel in unlocked state, and FIG. 4C is an illustration of the chisel in locked state;

FIGS. 7A and 7B are illustrations of a relevant portion of a second embodiment of the hydraulic shovel working machine in a state in which a bucket is tilted to allow attaching of a chisel, wherein FIG. 7A is a side elevational view, while FIG. 7B is a bottom plan view;

THE BEST MODE FOR CARRYING OUT THE INVENTION

Preferred embodiments of the hydraulic shovel with an arm incorporating a breaker in accordance with the present invention will be described with reference to the accompanying drawings.

Figure 1A:
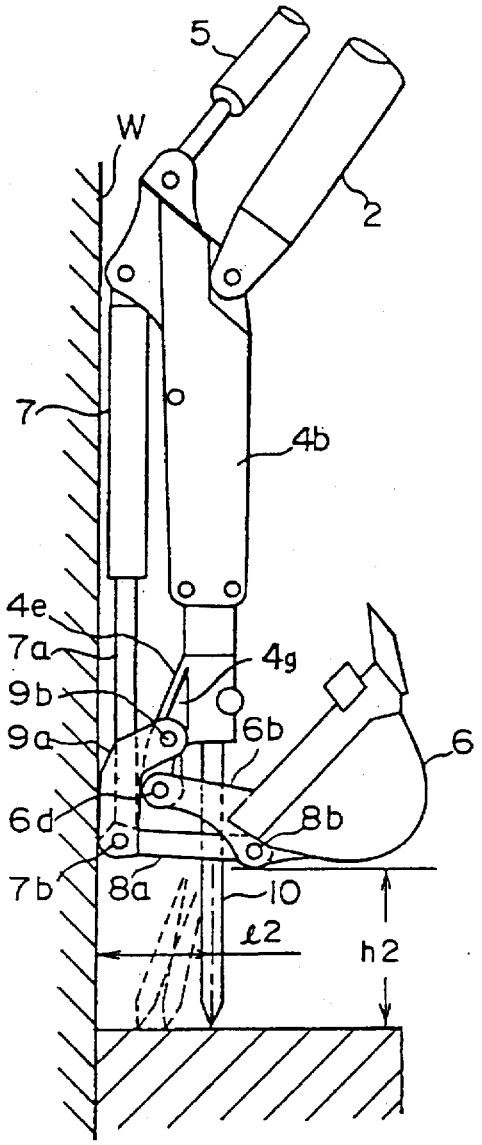
Figure 1B:
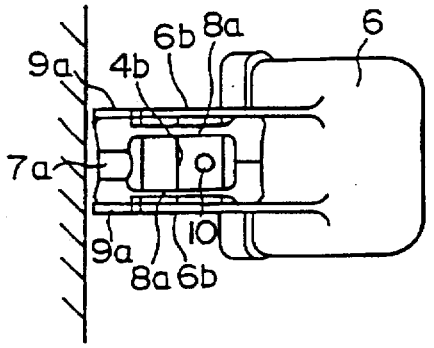
Figure 9:
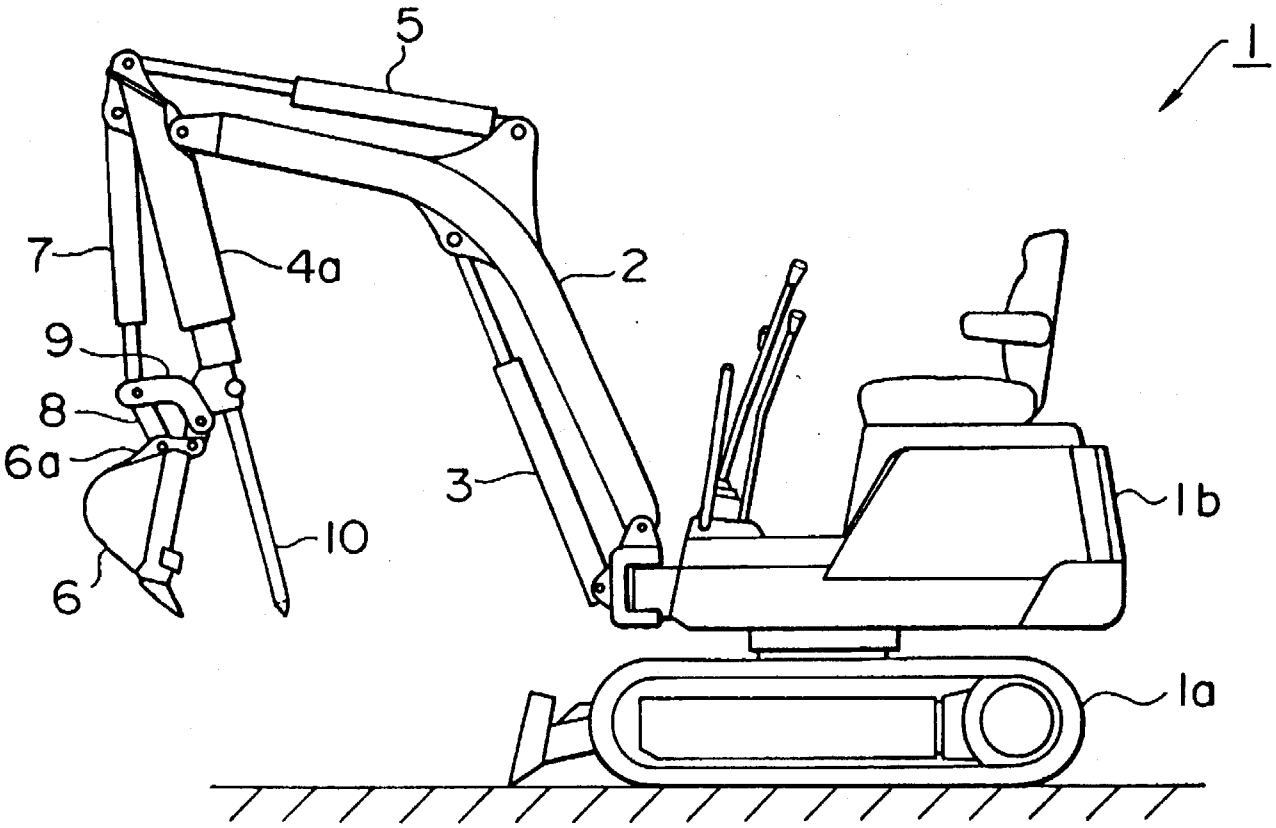
FIG.9 PRIOR ART
FIG. 9 is a side elevational view of a conventional hydraulic shovel apparatus with a chisel attached thereto.
Figure 10:
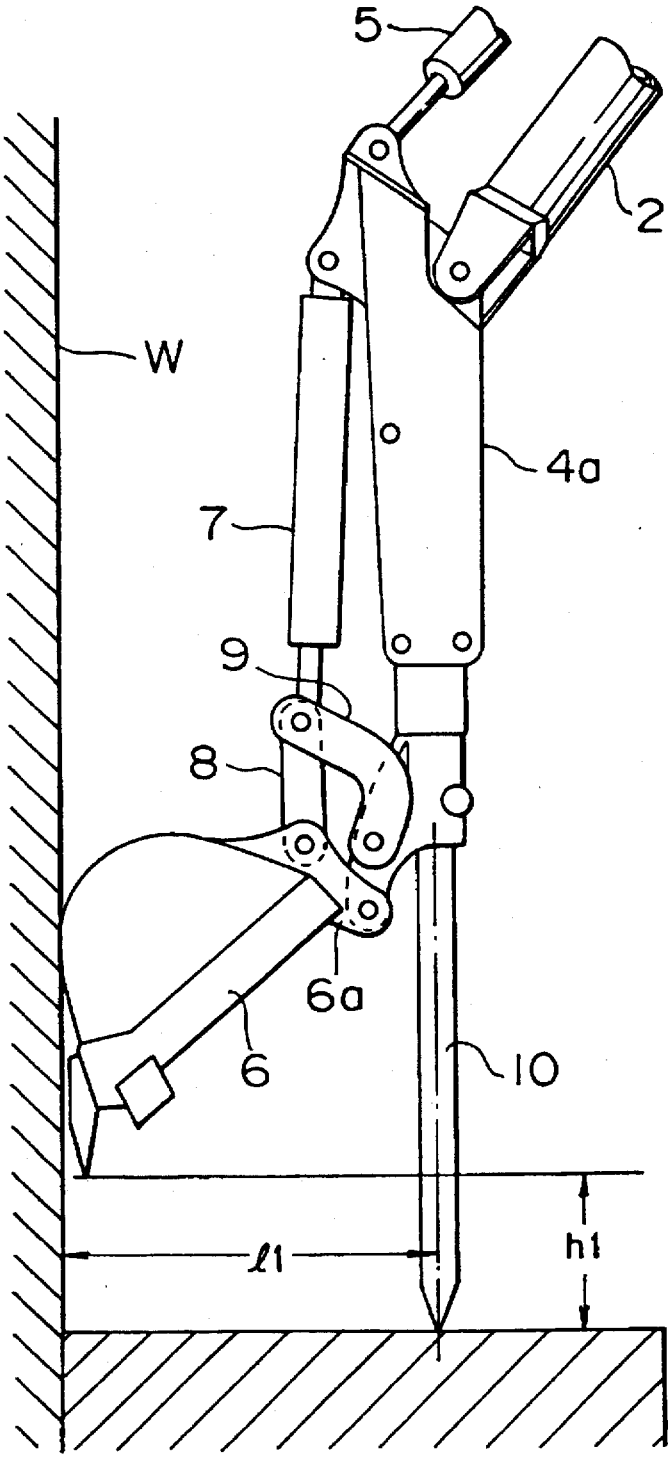
FIG. 10 PRIOR ART
FIG. 10 is a side elevational view of a relevant portion of a working machine on the hydraulic shovel apparatus of FIG. 9 under breaker work.

Referring to FIGS. 1A and 1B, which show a first embodiment of the hydraulic shovel with an arm incorporating a breaker, numeral **4*b* denotes an arm incorporating a breaker, similar to that 4*a* shown in FIGS. 9 or 10. The arm 4*b* has a front cap 4*e* to which a chisel 10 is attachable. The front cap 4e is provided at its end with a bracket 4*g* which is offset from a chisel mounting bore 4*h* (see FIG. 6A). Bucket brackets 6*b*, 6*b*, which are spaced from each other, are connected to the bracket 4*g* through bucket hinge pin 6*d* such that the bucket hinge pin 6*d* serves as a pivot for tilting or pivotal motion of the bucket 6. The bucket brackets 6*b*, 6*b*, fixed to the bucket 6, are connected to a pair of spaced parallel bucket links 8*a*, 8*b* through bucket link pin 8*b* which is located adjacent the bucket 6**.

The arrangement is such that the position of the bucket link pin **8*b* can be shifted to the side of a later-mentioned chisel 10 opposite to the bucket hinge pin 6*d*, when the bucket 6 is swung toward a tilted position about the bucket hinge pin 6*d* while the chisel 10 is not attached to the arm 4*b*. Therefore, the chisel 10, in order that it is attached, can be moved toward the front cap 4*e* of the arm 4*b* incorporating the breaker, through the space which is defined between the bucket hinge pin 6*d* and the bucket link pin 8*b* and, as shown in FIG. 1B, between the bucket links 8*a*, 8*a* and between the bucket brackets 6*b*, 6*b***.

The bucket links **8*a*, 8*a* are connected through a bucket cylinder top pin 7*b* to one end of an intermediate link 9*a*, the other end of which is connected to the bracket 4*g*, and are connected also to an end of a bucket cylinder rod 7*a*, so that the bucket 6 is actuated as a result of the operation of the bucket cylinder 7**.

According to this arrangement, a change-over from ordinary excavating operation to a breaker work is accomplished as follows. The bucket cylinder 7 is extended to move the bucket 6 to the tilted position. As a result of this operation, the bucket link pin **8*b* is shifted to a position opposite to the bucket hinge pin 6*d*. After this shifting, the chisel 10 is attached to the front cap 4*e* through the space defined between the bucket link pin 8*b* and the bucket hinge pin 6*d*, the space being formed between the pair of parallel bucket brackets 6*b*, 6*b* and between the parallel bucket links 8*a*, 8*a*. In this state, it is thus possible to execute the breaker work without demounting the tilted bucket 6, because the bucket 6** has been retracted to the tilted position.

It is assumed here that the breaker work is conducted at a position near a wall W, with the chisel 10 held in a vertical (up and down direction) position as shown in FIG. 1A. In this case, the distance $l_2$ between the chisel 10 and the wall W is much smaller than the distance $l_1$ (see FIG. 10) in the known arts. At the same time, the heightwise distance h2 between the lower end of the bucket 6 or the bucket link **8*a* and the road surface, such as a concrete-paved surface, is much greater than that h1 (see FIG. 10) between the end of the bucket 6 and the ground surface in the known arts, whereby the chisel penetration depth can be increased. When the breaking is required to reach a region in the close proximity of the wall W, the working machine is so controlled as to slightly incline the breaker-incorporating arm 4b** so that the breaker work can be done with the chisel positioned as shown by phantom lines in FIG. 1A. These advantages enhance the efficiency of the breaker work conducted in the area near a wall.

Figure 2A:
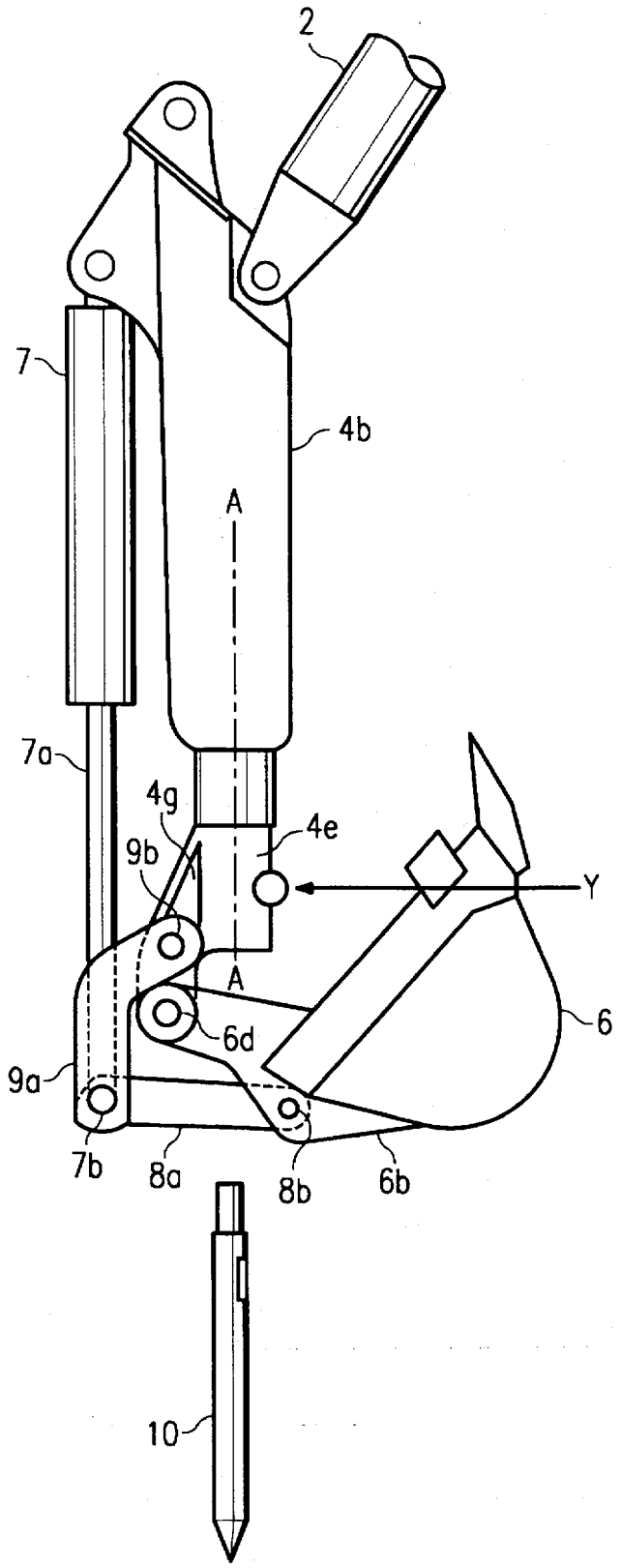
FIGS. 2A and 2B are a side elevational views of the relevant portion of the working machine, illustrative of the manner in which the chisel is detached while the bucket is in the tilted position or the dumping position, respectively.

After completion of the breaker work, the chisel 10 is extracted from the front cap 4e of the arm 4b incorporating the breaker as shown in FIG. 2A, so that the hydraulic shovel becomes ready for excavating work as is the case of an ordinary hydraulic shovel.

Figure 3:
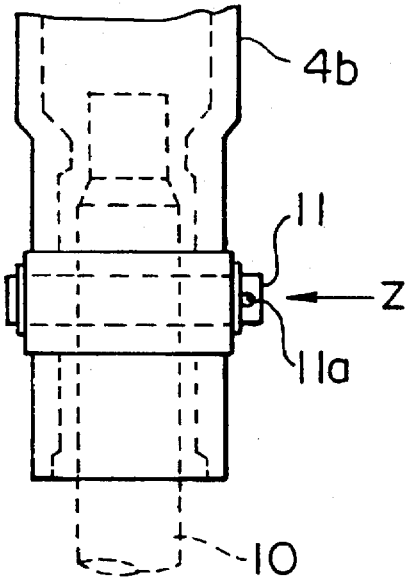
FIG. 3 is a view as viewed in the direction of the arrow Y in FIG. 2A.
Figure 4A:
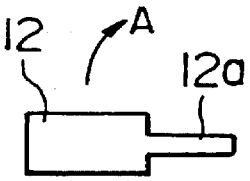
Figure 4B:
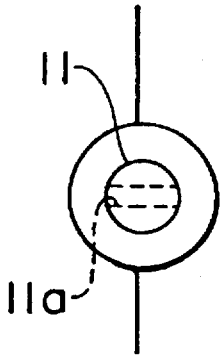

A description will now be given as to the method of attaching and detaching the chisel 10 to and from the arm 4b incorporating the breaker. Referring first to the attaching method, the chisel 10 is inserted into a bore formed in the end of the arm 4b incorporating the breaker, as shown in FIGS. 3, 4A and 4B. In this state, a pin portion 12a of a tool 12 is inserted into a pin-receiving bore 11a of a lock pin 11, and the tool 12 is rotated in the direction of the arrow A to the position shown in FIG. 4C. The tool 12 is then withdrawn. In this state, as will be seen from FIG. 5, the outer surface of the lock pin 11 contacts the surfaces of sleeves 4c, 4d provided in the front cap 4e of the arm 4b incorporating the breaker and the bottom of a recess 10a formed in the chisel 10, so that the chisel 10 is locked on the front cap 4e of the arm 4b incorporating the breaker. The breaker work is possible with this locked chisel.

Figure 4C:
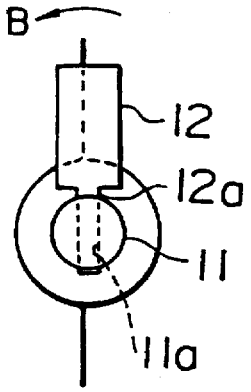
Figure 5:
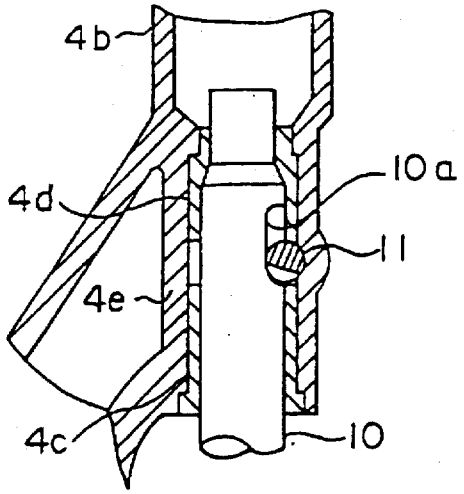
FIG. 5 is a sectional view corresponding to the A—A sectional plane of FIG. 2A, with the chisel attached and locked.
Figure 6A:
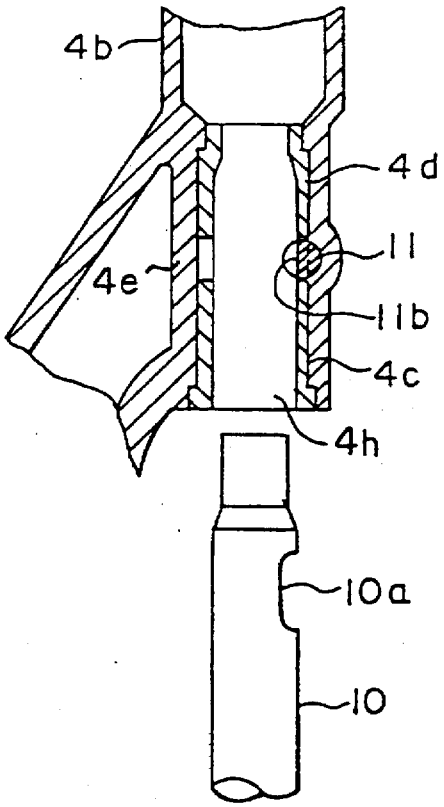
FIG. 6A is a sectional view corresponding to the A—A sectional plane of FIG. 2A, with the chisel detached.
Figure 6B:
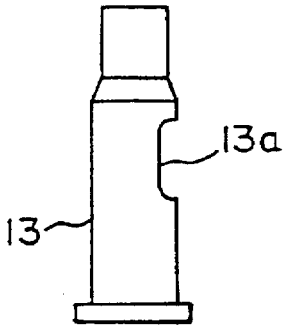
FIG. 6B is a side elevational view of a dummy cap to be inserted into a sleeve shown in FIG. 6A.

In order to conduct ordinary excavating operation, the chisel 10 is detached by a procedure reverse to that described above. Namely, the tool 12 is inserted into the pin-receiving bore 11a and is rotated in the direction of the arrow B as shown in FIGS. 4C and 4B, whereby the chisel is unlocked. In this unlocked state, as shown in FIG. 6A, a notched surface 11b of the lock pin 11 faces inwardly, so that the chisel 10 can easily be detached from the front cap 4e of the arm 4b incorporating the breaker without difficulty. It is thus possible to attach and detach the chisel 10 quickly and easily. After the detaching of the chisel 10, a dummy cap 13, having a recess 13a as shown in FIG. 6B, is inserted into the sleeves 4c, 4d and is locked in the same way as that for the chisel 10, thereby preventing soil and sand from entering the chisel mounting bore 4h in the sleeves 4c, 4d.

Figure 7A:
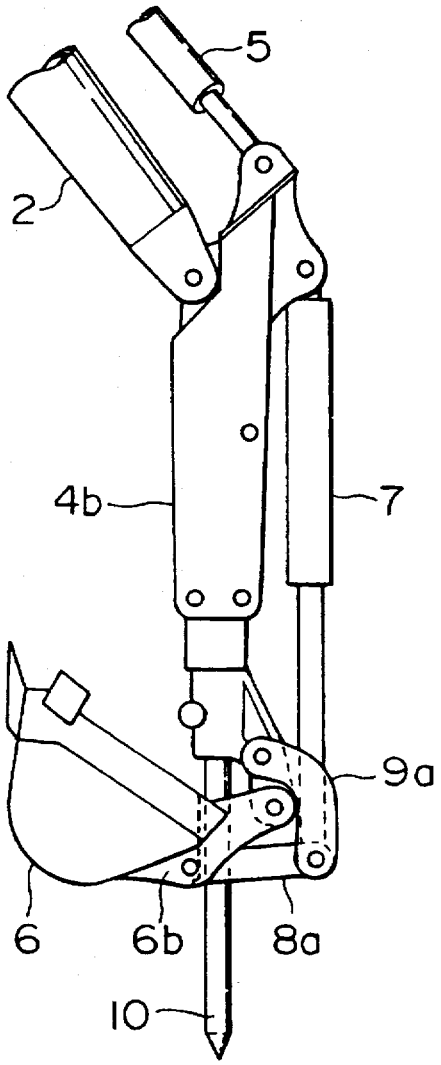
Figure 7B:
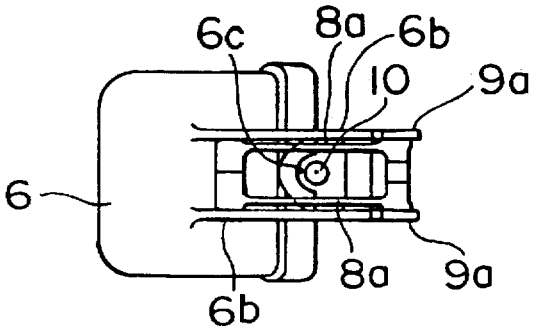
Figure 8:
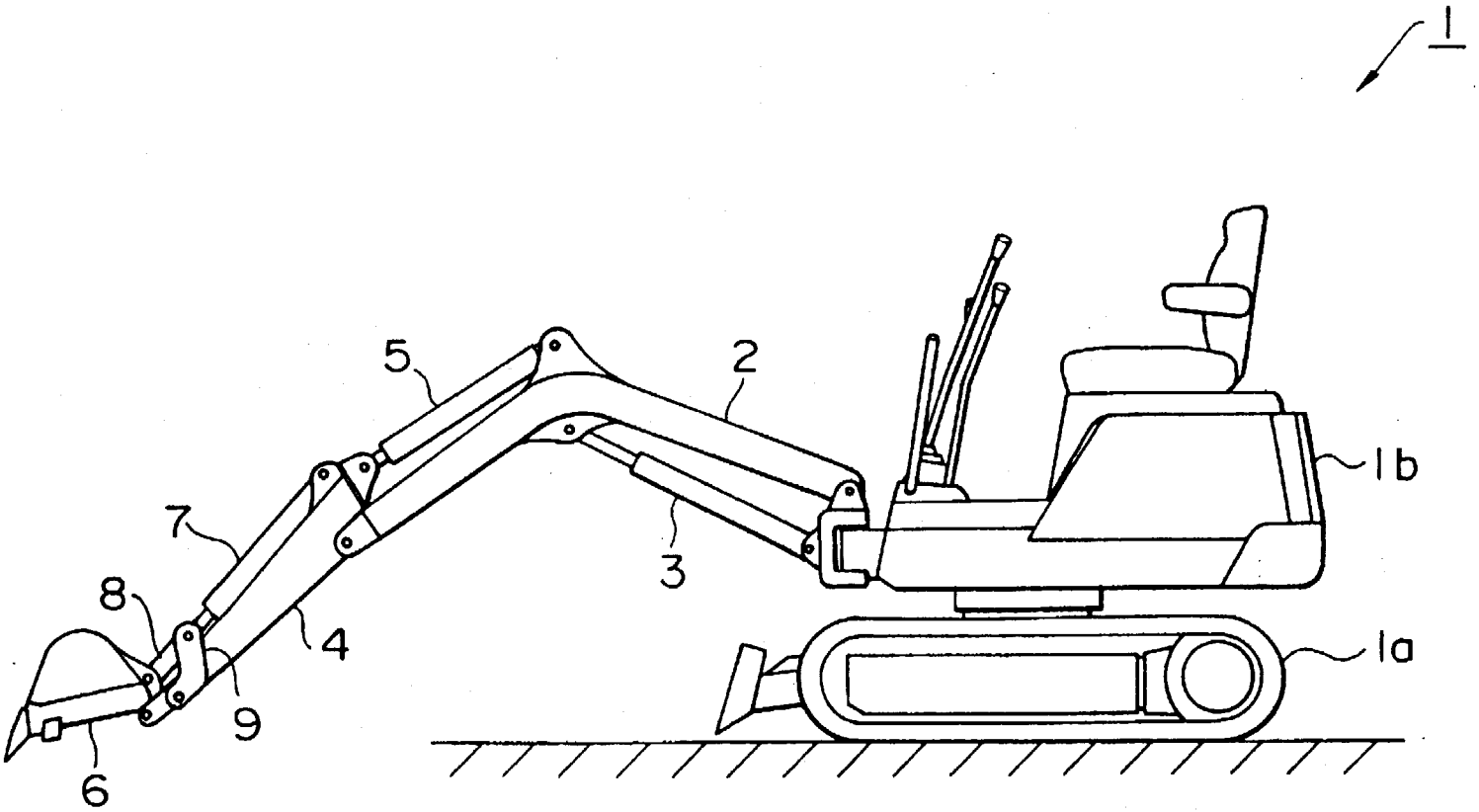
FIG. 8 PRIOR ART
FIG. 8 is a side elevational view of a conventional hydraulic shovel apparatus.

A second embodiment of the hydraulic shovel with an arm incorporating a breaker of the present invention will be described with reference to FIGS. 7A and 7B. The basic construction of the second embodiment is similar to that of the first embodiment, so that the following description will focus only on the points which discriminate the second embodiment. In this embodiment, an edge of the bucket 6 is notched as at 6c over a region substantially corresponding to the spacing between the pair of brackets 6b. The notch 6c is intended to prevent interference between the bucket 6 and the chisel 10 which otherwise may occur when the bucket 6 is held at the tilted position during attaching of the chisel 10 or during breaker work. The notch 6c enables the bucket 6 to be mounted closer to the chisel 10 than in the first embodiment, so that the lengths of the bucket brackets 6b and the bucket links 8a can be reduced as compared with those in the first embodiment. Thus, the second embodiment offers breaking performance equivalent to that of the first embodiment and can perform excavating operations with the same sense of control as that for the conventional working machine.

Figure 2B:
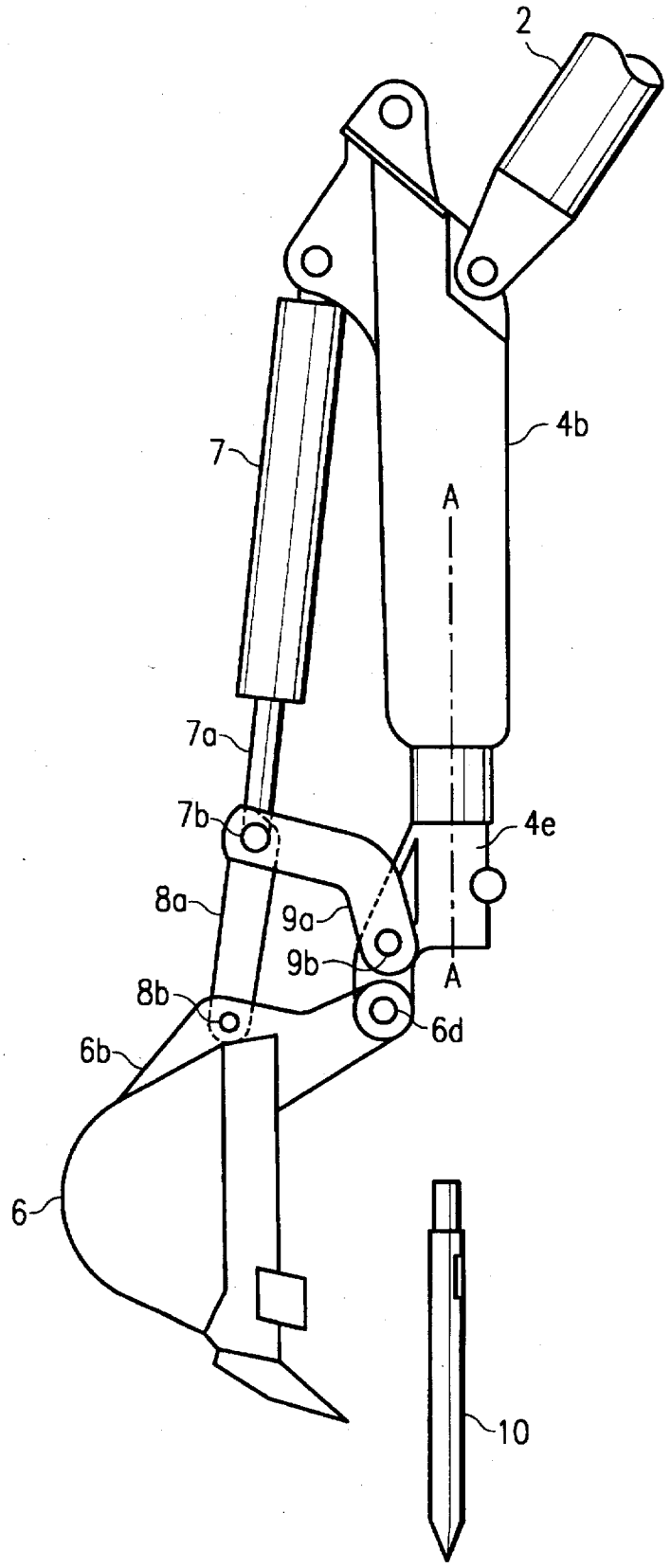

Although the hydraulic shovel with an arm incorporating a breaker in accordance with the invention has been described in detail, it is to be understood that the chisel can be attached while the bucket is in the dump position, as illustrated in FIG. 2B. Thus, the chisel can be attached either in a state in which the bucket is in the dumping position or in a state in which the bucket is in the tilted position, and one of these states can be selected as necessary so as to enable the working machine to easily clear any obstacle.

INDUSTRIAL APPLICABILITY

The hydraulic shovel with an arm incorporating a breaker of the present invention enables easy attaching and detaching of a chisel, both when the bucket is in the tilted position and when the same is in the dump position. The working machine also enables breaker work to be conducted in the close proximity of a wall, while enhancing the chisel penetration and, hence, breaker work efficiency.

What is claimed is:

1. A hydraulic shovel with an arm incorporating a breaker, comprising:

a boom pivotally connected to a hydraulic shovel;

the arm incorporating the breaker and pivotally connected to an end of said boom;

an arm cylinder pivotally connected between said arm incorporating the breaker and said boom;

a bucket having a pair of bucket brackets fixed thereto, each bucket bracket having one end pivotally connected to a bracket provided on an end of said arm incorporating said breaker;

a pair of bucket links each having one end pivotally connected to one of said bucket brackets and the other end pivotally connected to an intermediate link;

the intermediate link having one end pivotally connected to the bracket provided on the end of said arm incorporating the breaker and the other end pivotally connected to one of said bucket links; and a bucket cylinder having one end connected to said arm incorporating the breaker and the other end connected to said intermediate link and said bucket links;

wherein breaker work is performed with a chisel which, while said bucket is in a tilted condition, is attachable to the arm incorporating the breaker through a space defined between the pair of the bucket brackets and between the pair of bucket links at predetermined distances therefrom, and, while said bucket is in a dumping condition, is attachable to the same arm incorporating the breaker while said bucket is in the dumping condition.

2. A hydraulic shovel with an arm incorporating a breaker according to claim 1, wherein an edge of said bucket between said pair of bucket brackets is provided with a notch which is spaced a predetermined distance from said chisel attached to said arm incorporating the breaker while said bucket is in the tilted condition.

3. A hydraulic shovel with an arm incorporating a breaker, having a working machine which is mounted on a front portion of an upper turret structure and which includes a boom, said arm incorporating a breaker, a bucket, and a bucket cylinder, wherein a bucket hinge pin is provided on said arm incorporating the breaker with an offset from the axis of said arm incorporating the breaker towards said bucket cylinder, and wherein breaker work is performed with a chisel which, while said bucket is in a tilted condition, is attachable to the arm incorporating the breaker through a space defined between the bucket hinge pin and a bucket link pin, and, while said bucket is in a dumping condition, is attachable to the same arm incorporating the breaker while said bucket is in the dumping condition.

4. A hydraulic shovel with an arm incorporating a breaker according to claim 3, wherein the attaching of the chisel in the state in which said bucket is in the tilted condition is conducted through a space defined between said bucket hinge pin and said bucket link pin and between a pair of bucket brackets which are spaced a predetermined distance from each other.

5. A hydraulic shovel with an arm incorporating a breaker, comprising:

an arm (4b) incorporating a breaker main structure and including a chisel (10), only a base portion of said chisel (10) being received in said arm so as to be connected to said breaker main structure;

a bucket (6) mounted on an end of said arm (4b); and a link mechanism including a bucket cylinder (7) for actuating said bucket (6), an intermediate link (9a) and a bucket link (8a);

characterized in:

that a bracket (4g) is disposed at a lateral side adjacent the end of said arm (4b) at an offset to one side from said chisel (10);

that a bucket hinge pin (6d) serving as a pivot for the pivotal motion of said bucket (6) is provided on said bracket (4g) at a position deviating from the end of said arm (4b);

that a bucket link pin (8b) interconnecting said bucket (6) and said bucket link (8a) is located at a position on the rear side of said bucket (6) which, when said bucket (6) is rotated counterclockwise about said bucket hinge pin (6d), moves to a position on the side of said chisel (10) opposite to said bucket hinge pin (6d);

that, by means of a link mechanism including said intermediate link (9a) connected through a pin to said bracket (4g) and said bucket link (8a) connected through a pin to said intermediate link (9a); and that said bucket link pin (8b) is located at a position which is beyond said chisel (10) in the counterclockwise direction, whereby said chisel (10) can be inserted into the end of said arm (4b) through a space defined between said bucket hinge pin (6d) and said bucket link pin (8b), thereby enabling said hydraulic shovel to perform breaker work.

6. A hydraulic shovel with an arm incorporating a breaker according to claim 5, wherein said bucket hinge pin (6d) is disposed on said bracket (4g) laterally offset from the end of said arm (4b) and projecting to one side of said chisel (10).

7. A hydraulic shovel comprising:

a main structure including a lower traveling structure and an upper turret structure;

a boom having a first end and a second end, said first end of said boom being pivotally connected to said upper turret structure;

an arm incorporating a breaker mechanism; said arm having a first end, a second end, and an axis; said first end of said arm being pivotally connected to said boom at a location remote from said first end of said boom; said second end of said arm being adapted to detachably receive a chisels, said chisel having a first end and a second end;

an arm cylinder having a first end and a second end, said first end of said arm cylinder being pivotally connected to said boom, said second end of said arm cylinder being connected to said first end of said arm;

an offset bracket connected to said second end of said arm and extending outwardly from the axis of said arm;

a bucket having a rear face;

a pair of spaced apart bucket brackets, each of said bucket brackets having a first end and a second end, with the first end of each of said bucket brackets being pivotally connected to said offset bracket, and the second end of each of said bucket brackets being secured to said rear face of said bucket, the spacing between the spaced apart bucket brackets being greater than an outside diameter of said chisel;

an intermediate link having a first end and a second end, with said first end of said intermediate link being pivotally connected to said offset bracket;

a pair of bucket links, each of said bucket links having a first end and a second end, with the first end of each of said bucket links being pivotally connected to a respective one of said bucket brackets, and the second end of each of said bucket links being pivotally connected to the second end of said intermediate link; and a bucket cylinder having a first end and a second end, with the first end of said bucket cylinder being pivotally connected to said arm and the second end of said bucket cylinder being pivotally connected to said second end of said intermediate link;

said offset bracket being offset from said axis of said arm toward said bucket cylinder so that the pivotal connection of the first end of each of said bucket brackets to said offset bracket is offset from said axis of said arm toward said bucket cylinder whereby:

when said bucket cylinder is contracted to move said bucket to a dumping position, said chisel can be attached to said second end of said arm so that breaker work can be performed with the attached chisel without requiring said bucket to be demounted from said arm; and when said bucket cylinder is extended to move said bucket toward said main structure in a tilted position, said chisel can be positioned in a space between said bucket brackets and between said bucket links without interference, and the thus positioned chisel can be attached to said second end of said arm so that breaker work can be performed with the thus attached chisel without requiring said bucket to be demounted from said arm.

8. A hydraulic shovel in accordance with claim 7, wherein said space is between said second end of said bucket cylinder and an edge of said bucket, said edge of said bucket extending between the pair of bucket brackets and being provided with a notch to prevent interference between said bucket and the chisel which otherwise might occur when said bucket is held at the tilted position during attaching of the chisel to the arm or during breaker work.

9. A hydraulic shovel in accordance with claim 7, wherein the first end of each of said bucket brackets is pivotally connected to said offset bracket by a bucket hinge pin, with the bucket hinge pin being offset from the axis of said arm toward said bucket cylinder.

10. A hydraulic shovel in accordance with claim 9, wherein the first end of each of said bucket links is pivotally connected to a respective one of said bucket brackets by a bucket link pin.

11. A hydraulic shovel in accordance with claim 10, wherein said space between said bucket brackets and between said bucket links is also between the bucket hinge pin and the bucket link pin.

12. A hydraulic shovel in accordance with claim 11, wherein said second end of said arm comprises a front cap having said offset bracket extending outwardly therefrom, wherein said front cap contains a bore for receiving said first end of the chisel, and a locking mechanism for locking the first end of the chisel within said bore.

13. A hydraulic shovel in accordance with claim 7, wherein said second end of said arm comprises a front cap having said offset bracket extending outwardly therefrom, wherein said front cap contains a bore for receiving said first end of the chisel, and a locking mechanism for locking the first end of the chisel within said bore.

14. A hydraulic shovel in accordance with claim 13, wherein said first end of said chisel has a recess, and wherein said locking mechanism comprises a rotatable pin having a first rotation position wherein said rotatable pin engages the recess in said chisel to lock said first end of said chisel in said bore, and a second rotation position wherein said rotatable pin does not engage the recess in said chisel, thereby permitting the chisel to be easily attached to and detached from said front cap.

* * * * *